US008668379B2

(12) United States Patent
Nguyen et al.

(10) Patent No.: US 8,668,379 B2
(45) Date of Patent: Mar. 11, 2014

(54) WATCH DISPLAY ASSEMBLY

(75) Inventors: Le Duy Quan Nguyen, Neyruz (CH); Nicolas Allemann, Montlebon (FR)

(73) Assignee: Tissot S.A., Le Locle (CH)

( * ) Notice: Subject to any disclaimer, the term of this patent is extended or adjusted under 35 U.S.C. 154(b) by 0 days.

(21) Appl. No.: 13/359,052

(22) Filed: Jan. 26, 2012

(65) Prior Publication Data

US 2012/0201106 A1 Aug. 9, 2012

(30) Foreign Application Priority Data

Jan. 28, 2011 (EP) ..... 11152583

(51) Int. Cl.
*A47F 7/00* (2006.01)
*G04B 37/00* (2006.01)

(52) U.S. Cl.
USPC ..... 368/316; 248/116

(58) Field of Classification Search
USPC ..... 368/316–317; 211/1.51–1.53; 248/114–116
See application file for complete search history.

(56) References Cited

U.S. PATENT DOCUMENTS

| | | | | | |
|---|---|---|---|---|---|
| 188,864 | A | * | 3/1877 | Davies | 248/474 |
| 2,957,252 | A | * | 10/1960 | Pain | 434/136 |
| 3,062,491 | A | * | 11/1962 | Green | 248/116 |
| 3,191,901 | A | * | 6/1965 | Green | 248/116 |
| 3,870,880 | A | * | 3/1975 | Merigoux et al. | 378/81 |
| 4,887,250 | A | * | 12/1989 | Vuarnesson | 368/15 |
| 2009/0032478 | A1 | | 2/2009 | Johnson et al. | |

FOREIGN PATENT DOCUMENTS

| | | | |
|---|---|---|---|
| WO | WO 03/037147 | A2 | 5/2003 |
| WO | WO 2008/064572 | A1 | 6/2008 |

* cited by examiner

*Primary Examiner* — Sean Kayes
(74) *Attorney, Agent, or Firm* — Sughrue Mion, PLLC

(57) ABSTRACT

Watch display assembly including a watch support element (2), characterized in that the support element (2) is arranged to rotate on two perpendicular axes (X-X; Y-Y).

7 Claims, 2 Drawing Sheets

WATCH DISPLAY ASSEMBLY

This application claims priority from European Patent Application No. 11152583.8 filed Jan. 28, 2011, the entire disclosure of which is incorporated herein by reference.

FIELD OF THE INVENTION

The present invention concerns a watch display assembly. The present invention concerns more specifically a display assembly for a self-winding watch.

BACKGROUND OF THE INVENTION

Usually, watches are displayed statically in the retailer window display and are oriented so that the dial is visible to potential customers. This is disadvantageous if the watch has a transparent back cover which allows all or part of the watch movement to be seen, in particular when the watch has a self-winding mechanism using an oscillating weight. Indeed, as the back cover is located at the back of the watch, it remains invisible to the passer-by.

One solution to this problem consists in displaying two identical watches side by side, one with the dial side showing and the other with the back cover side showing. However, this solution requires sufficient space to be available in the window display and is difficult to apply to each watch model displayed.

Another solution consists in using a set of mirrors to reveal the back side of the watch to passers by. However, this requires arranging the watch in a very precise manner relative to the mirrors, which is time consuming and tedious. Moreover, depending upon the position of the potential customer relative to the watch and the direction in which he is looking, optical deformation effects may occur. In some assemblies, the potential purchaser may not even be able to see the image reflected by the mirrors at all.

SUMMARY OF THE INVENTION

It is an object of the present invention to overcome the aforementioned drawbacks by providing a watch display assembly which enables the potential purchaser to see the front face of the dial side of the displayed watch as well as the rear face of the back cover side, in a dynamic manner and without any visualisation problems.

The present invention therefore concerns a watch display assembly including a support element for the watch, said support element being arranged to rotate on two perpendicular axes.

Owing to these features, the present invention provides a watch display assembly which displays the watch in a dynamic, attractive manner. Further, the display assembly according to the invention allows the watch to be displayed alternately from the dial side and from the back cover side, which enables the potential purchaser to properly appreciate the various technical and aesthetical features of the displayed watch. Moreover, since the watch is permanently in motion, in the assembly of a self-winding watch, this winds the barrel spring via the oscillating weight. A self-winding watch displayed to the public by means of the display assembly of the invention is therefore always set to the correct time.

According to a complementary feature of the invention, the two axes of rotation of the watch support element extend respectively horizontally and vertically.

According to another feature of the invention, the watch support element is centred on the point of intersection between the two axes of rotation.

According to yet another feature of the invention, the watch support element is a ring, pivotably mounted between two uprights which are integral with a rotating plate arranged in a base.

According to a first variant of the invention, the ring and the plate are driven in rotation by a single motor housed in the base of the display assembly.

According to a second variant of the invention, the rotating plate is driven in rotation by a first motor housed in the base of the display assembly, and the support ring for the watch is driven by a second motor mounted on the rotating plate.

According to yet another feature of the invention, the motor or motors are powered by the electric power grid or by means of a battery charged by solar cells.

BRIEF DESCRIPTION OF THE DRAWINGS

Other features and advantages of the present invention will appear more clearly from the following detailed description of an embodiment of the watch display assembly according to the invention, this example being given solely by way of non-limiting illustration with reference to the annexed drawing, in which.

DETAILED DESCRIPTION OF THE PREFERRED EMBODIMENTS

Figure 1:
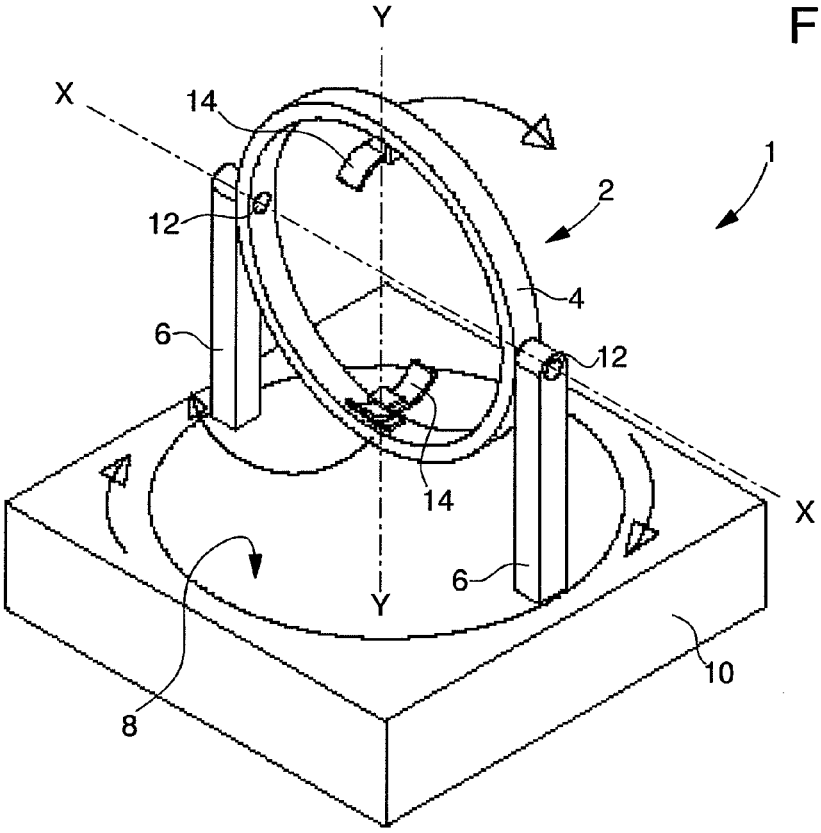
FIG. 1 is a perspective view of the watch display assembly according to the invention.

FIG. 1 is a perspective view of the display assembly according to the invention. Designated as a whole by the general reference number 1, the display assembly includes a watch support element 2. In the example shown in the drawing, this support element 2 takes the form of a ring 4, pivotably mounted between two uprights 6, which are secured to a rotating plate 8 arranged in a base 10 of display assembly 1.

Ring 4 is mounted between the two uprights 6 by means of two pin ends 12 which project into two diametrically opposite apertures arranged in ring 4. These two pin ends 12 define a horizontal axis of rotation X-X of ring 4. Ring 4 also includes two strips 14 for securing the watch.

Uprights 6 stand vertical to the surface of rotating plate 8 and are arranged diametrically opposite each other on plate 8 which has the shape of a horizontally extending disc. This rotating plate 8 defines a vertical axis of rotation Y-Y of ring 4.

It will be clear that, by design, the point of intersection between the two horizontal X-X and vertical Y-Y axes of rotation merges with the geometrical centre of ring 4.

Figure 2:
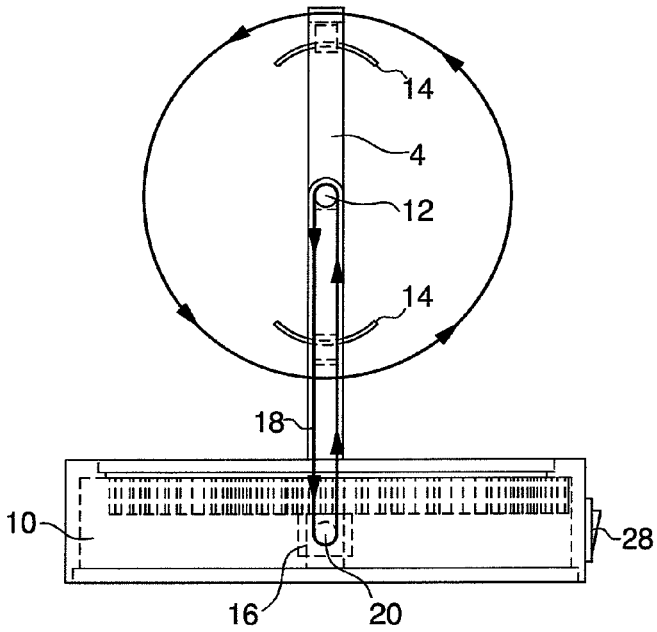
FIG. 2 is a cross-section illustrating the belt and pulley drive system which rotates the watch support ring about the horizontal axis.

FIG. 2 is a cross-section illustrating the drive system which ensures the rotation of watch support ring 4 about the horizontal axis X-X. This drive system includes a first motor 16 which is mounted on rotating plate 8 and rotates with said plate 8. This first motor 16 is housed within the thickness of rotating plate 8 so as to be hidden from view. It drives, either directly or via a gear train, a belt 18 which is housed inside one of uprights 6. This belt 18 is passed over the pin end 12 corresponding to the top end of upright 6 and over a pulley 20 integral with the arbour of motor 16 arranged at the base of upright 6.

Figure 3:
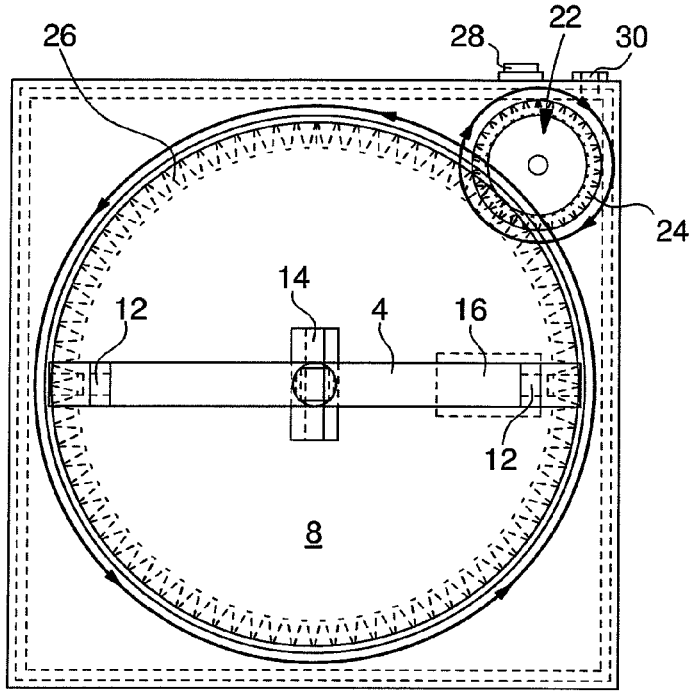
FIG. 3 is a top view of the base of the display assembly showing the means for driving the plate in rotation.

FIG. 3 is a top view of base 10 of display assembly 1, showing the means for driving rotating plate 8 in rotation. This drive means includes a second motor 22 housed within the volume of base 10. This second motor 22 drives a toothed wheel 24, which meshes with a peripheral toothing 26 arranged over the entire circumference of rotating plate 8.

First and second motors 16 and 22 are powered either by current from the electric power grid or by means of solar cells which are arranged on the surface of rotating plate 8 and respectively power batteries connected to motors 16 and 22. If motors 16, 22 are powered by the electric power grid, display assembly 1 is provided with an electric switch 28 and an outlet 30.

Figure 4:
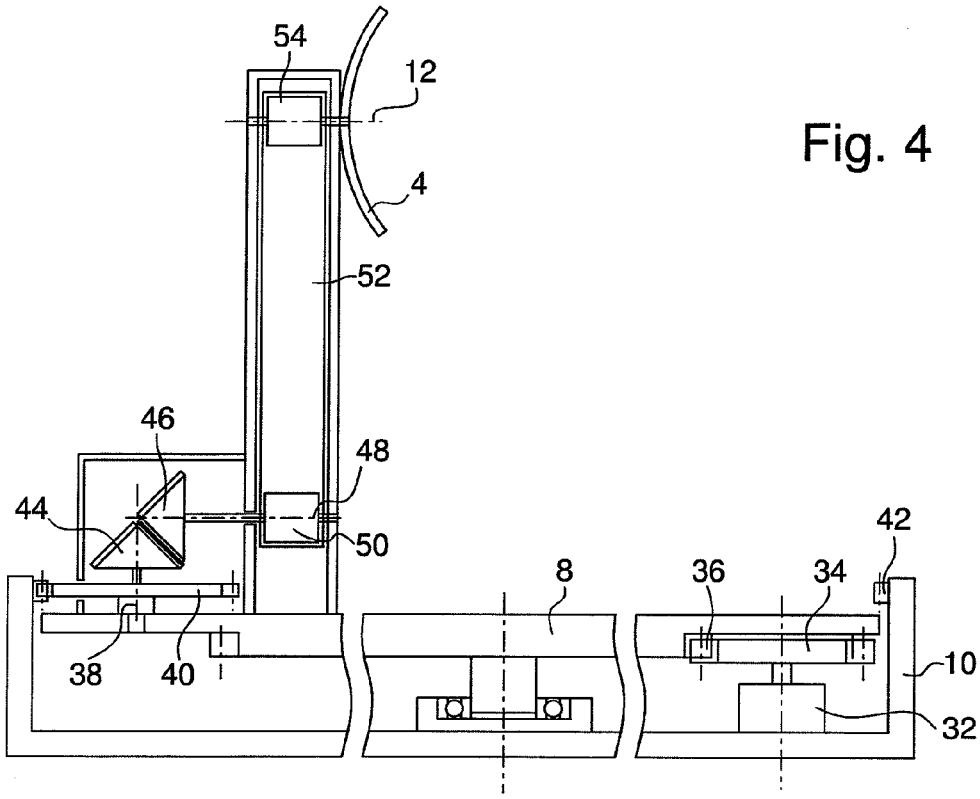
FIG. 4 is a schematic diagram of the single motor housed in the display assembly base and simultaneously driving in rotation the watch support ring and the plate.

According to a variant, watch support ring 4 could be driven along the two axes of rotation X-X and Y-Y by a single motor 32. FIG. 4 is a schematic diagram of this embodiment wherein the single motor 32 is housed in the base 10 of display assembly 1 and simultaneously drives in rotation watch support ring 4 and rotating plate 8. Therefore, the single motor 32 drives a toothed wheel 34 which meshes with a peripheral toothing 36, which extends over the entire perimeter of rotating plate 8. Rotating plate 8 carries a rotating arbour 38 on which a toothed wheel 40 is fixedly mounted. When plate 8 is rotating, toothed wheel 40 rolls over a fixed peripheral toothing 42 arranged along the inner periphery of base 10. As it rotates, toothed wheel 40 drives a first conical pinion 44 integral with rotating arbour 38. This first conical pinion 44 in turn drives a second conical pinion 46 mounted on a common arbour 48 with a pulley 50 over which a belt 52 is passed. Belt 52 is passed over a second pulley 54 mounted on pin end 12 which carries support ring 4.

What is claimed is:

1. A watch display assembly comprising:

a watch support element, wherein the support element is arranged to rotate on two perpendicular axes, wherein the watch support element is a ring pivotably mounted between two uprights, and wherein the two uprights are secured to a rotating plate arranged in a base.

2. The display assembly according to claim 1, wherein the single motor drives a toothed wheel which meshes with a peripheral toothing, which extends over the entire perimeter of the rotating plate, and in that the rotating plate carries a rotating arbour on which there is fixedly mounted a toothed wheel, which rolls over a fixed peripheral toothing arranged along the inner periphery of the base, the toothed wheel driving a first conical pinion which is secured to the rotating arbour and which in turn drives a second conical pinion mounted on a common arbour with a pulley, over which a belt is passed, the belt passing over a second pulley mounted on a pin end which carries the support ring.

3. The display assembly according to claim 1, wherein the rotating plate is driven in rotation by a first motor housed in the base of the display assembly, and in that the watch support ring is driven by a second motor mounted on the rotating plate.

4. The display assembly according to claim 3, wherein the motors are powered by the electric power grid or by means of a battery charged by solar cells.

5. The display assembly according to claim 3, wherein the first motor drives a belt housed within the thickness of one of the uprights and which is passed, at the top end of the upright, over a pin end used for assembling the ring on the upright, and over a pulley integral with the arbour of the first motor and arranged at the base of the upright, and in that the second motor drives a toothed wheel which in turn meshes with a peripheral toothing arranged over the entire circumference of the rotating plate.

6. The display assembly according to claim 5, wherein the ring and the plate are driven in rotation by a single motor housed in the base of the display assembly.

7. The display assembly according to claim 6, wherein the motors is powered by the electric power grid or by means of a battery charged by solar cells.

* * * * *